US007845505B2

(12) United States Patent
Hamamoto et al.

(10) Patent No.: US 7,845,505 B2
(45) Date of Patent: Dec. 7, 2010

(54) CONTAINER CAP

(75) Inventors: Keiji Hamamoto, Osaka-fu (JP); Seiji Yoshimura, Ibaraki (JP); Shitomi Tamaoki, Tokyo-to (JP)

(73) Assignee: Taisei Kako Co., Ltd. (JP)

( * ) Notice: Subject to any disclaimer, the term of this patent is extended or adjusted under 35 U.S.C. 154(b) by 652 days.

(21) Appl. No.: 10/559,004

(22) PCT Filed: Jun. 3, 2004

(86) PCT No.: PCT/JP2004/007705

§ 371 (c)(1),
(2), (4) Date: May 5, 2006

(87) PCT Pub. No.: WO2004/108549

PCT Pub. Date: Dec. 16, 2004

(65) Prior Publication Data

US 2007/0272648 A1 Nov. 29, 2007

(30) Foreign Application Priority Data

Jun. 3, 2003 (JP) ..... 2003-158728

(51) Int. Cl.
*B65D 41/62* (2006.01)

(52) U.S. Cl. ..... 215/277; 215/249; 215/274; 215/275; 215/280; 215/355; 220/319; 220/324; 220/784; 220/786

(58) Field of Classification Search ..... 215/274, 215/275, 277, 280, 355, 324, 784, 786; 220/319, 220/324, 784, 786
See application file for complete search history.

(56) References Cited

U.S. PATENT DOCUMENTS

| | | | | | |
|---|---|---|---|---|---|
| 5,085,332 | A | * | 2/1992 | Gettig et al. | 215/249 |
| 5,348,174 | A | * | 9/1994 | Velicka | 215/277 |
| 5,879,345 | A | * | 3/1999 | Aneas | 604/411 |
| 5,957,314 | A | * | 9/1999 | Nishida et al. | 215/249 |
| 6,158,604 | A | * | 12/2000 | Larguia et al. | 215/217 |
| 2003/0177629 | A1 | | 9/2003 | Thibault et al. | |

FOREIGN PATENT DOCUMENTS

| | | |
|---|---|---|
| JP | 59-221249 | 12/1984 |
| JP | 2000-85824 | 3/2000 |
| JP | 2001-171717 | 6/2001 |

* cited by examiner

*Primary Examiner*—Anthony Stashick
*Assistant Examiner*—Elizabeth Volz
(74) *Attorney, Agent, or Firm*—Wood, Phillips, Katz, Clark & Mortimer

(57) ABSTRACT

A container cap locking a plug member to a mouth by a locking member and capable of being removed from the mouth together with the plug member by repositioning a holder member. The locking member is covered on the container mouth so as to hold the plug and the holder member is fitted to the outer peripheral sides of a plurality of locking pieces of the locking member. In each locking piece, an upper side part is connected to a lower side part through a thin-walled bending part. The upper side part is locked to the rubber plug from the lower side with the holder member on the outer peripheral side thereof. The lower side part is locked to the container mouth from the lower side by the holder member. Locking projected parts prevent the lower end of the holder member from coming out of the upper side part.

17 Claims, 6 Drawing Sheets

CONTAINER CAP

FIELD OF THE INVENTION

The present invention relates to a container cap, which holds a plug member such as a rubber container plug firmly by being put on the mouth of the container sealed by the plug.

BACKGROUND ART

Conventional containers such as vials, which hold drugs, are sealed pathways to mouths with sufficiently sterilized rubber plugs in order to store and carry the drugs in hygienic conditions. They are provided with lock means to the rubber plugs around the mouths so as to prevent these rubber plugs from loosening up and the conditioner from deterioration caused by air inflow through a gap between the rubber plugs and the mouths.

As with the lock means described above, the applicant of the present invention has disclosed the cap which comprises a close-fastening ring detachably formed on an upper portion of a crown-like member surrounding a rubber plug in the corresponding document 1. It is used in such a manner that the close-fastening ring is cut off from the crown-like member and put on the outer periphery of the member by pressing the ring towards the mouth.

Description of corresponding document 1: Japanese Unexamined Patent Publication No. 09-278051 (see FIG. 6 and FIG. 7).

For containers of drug in particular, there are many cases in which the adhesion between the mouth portion of the container and the rubber cap is set up at a high degree. For this reason, it is difficult to detach the rubber plug, while it is easy to detach the aforementioned conventional cap (lock means); and this has caused inconveniences in carrying out the medical activities.

SUMMARY OF THE INVENTION

The object of the present invention is to provide a container cap, which enables pulling out the rubber plug from the mouth portion of the container at the same time as removing the cap from the container.

In order to achieve this object, the present inventors have employed a technological feature as summarized below.

A container cap, according to the present invention, is put on a mouth of a container to top a plug member fitted into the mouth. The cap comprises a locking member which has a top plate with a rim and a plurality of locking pieces located around the rim, and a holder member which is mounted surrounding the outer periphery of the locking pieces, wherein each locking piece is extending downward from the rim, wherein each locking piece comprises an upper side part and a lower side part connected by a thin-walled bendable part located midway through the piece in the longitudinal direction thereof, wherein the upper side part is locked to said plug member from below in a state where the holder member is mounted on the outer periphery of the upper side part thereof, wherein said lower side part is locked to said mouth from below in a state where the holder member mounted on the outer periphery of the lower side part thereof, wherein said holder member is movable upwards and downwards relative to the locking member, and wherein said holder member and/or said locking member has a locking projected part which prevents the lower edge of the holder member from moving higher relative to the upper side part of the locking piece.

According to the cap of the present invention, by pushing down the holder member so that the holder member holds the plurality of locking pieces altogether, during attaching the cap to the mouth (capping), the lower side part of the locking piece is engaged with the mouth from below and the plug is locked without fail. On the other hand, during the operation of opening the plug, by pulling the holder member upwards, the holder member moves upwards, disengages from the lower side part, and engages with the locking projected part so that the locking member is pulled out upwards with the holder member. The lower edge of the holder member holds the outer periphery of the upper side part so that the upper side part is engaged with the plug member from below; and this enables pulling out the holder member, the locking member, and the plug upwards altogether. According to the present invention, it is possible to detach the holder member, the locking member, and the plug altogether by only a single operation such as pulling out the holder member.

Additionally, said locking projected part is preferably formed at the lower edge of the holder member and the outer periphery of the upper side part of the locking piece of the locking member. According to this, it is possible to disengage the holder member from the lower side part of the locking piece completely and to lock the locking pieces together with holding the upper side part firmly by the holder member. To achieve the more secure engaging of the lower side part to the mouth, the outer periphery of the lower side part is preferably larger than the outer periphery of the upper side part so that the lower side part is firmly tightened up inward.

In the cap of the said present invention, each of the holder member and the locking piece may have the locking projected part, the locking projected part of the holder member being formed on the inner periphery of the lower edge of the holder, the locking projected part of the locking piece being formed on the outer periphery of the upper side part, and the cap further comprising a connecting part which connects the upper edge of the holder and the lower edge of the holder and may be severable by pushing down the holder member relative to the locking member, and the holder member, the locking member, and the connecting part being integrally molded. According to this, the connecting part is formed at the locking projected part of the inner periphery of the lower edge of the holder member, and the projected part and concave part are only at the lower edge of the holder; so that it is possible to avoid the useless scratching caused by a vestige of the connecting part severed during pushing and pulling the holder member.

PREFERRED EMBODIMENT OF THE PRESENT INVENTION

Figure 1:
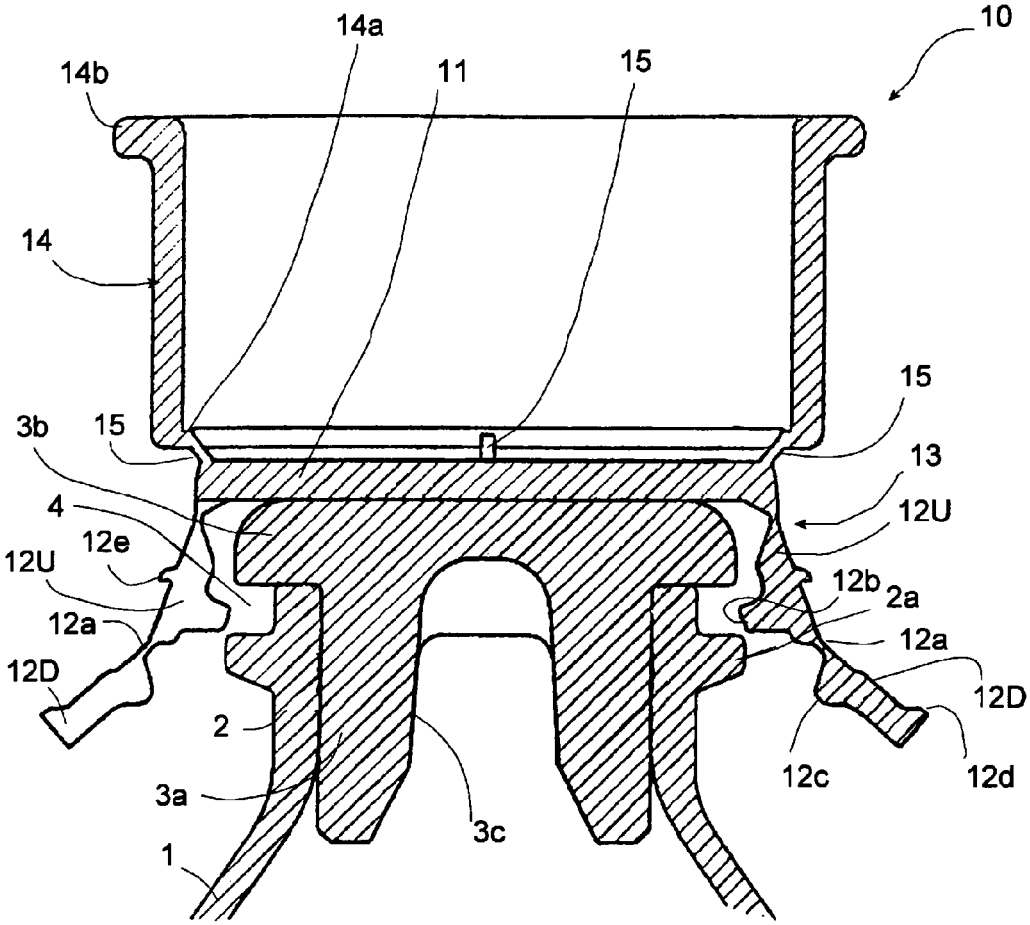
FIG. 1 is a longitudinal sectional view of a cap fixed to the mouth according to one embodiment of the present invention.

With reference to the attached drawings, the present invention will hereinafter be described by way of an embodiment thereof.

FIGS. 1 to 6 illustrate a collet plastic cap 10 according to the embodiment of the present invention. The cap 10 is fixed on an upper mouth 2 of a vial (a container) 1 and tops a rubber plug 3, which is fitted tightly into the mouth 2.

The vial 1 is a transparent glass container. The mouth 2 has a cylindrical shape, and a flange 2*a* projects from the outer periphery of the mouth 2. Between the upper edge surface of the mouth 2 and the flange 2*a*, there is a gap 4 extending toward upwards and downwards.

The rubber plug 3 comprises an airtight portion 3a put in the mouth 2 and a flange 3*b*, from which the airtight portion 3*a* depends and which makes contact with the upper edge surface of the mouth 2, as a single piece. The airtight portion 3*a* extends a significant distance into the mouth. The external diameter of the flange 3*b* is larger than the one of the upper edge surface of the mouth 2; and it is made to be almost the same scale as the one of the flange 2*a* of the mouth 2. A concave part 3*c*, which extends upward from the bottom of the airtight portion 3*a*, is formed at the side of the airtight portion 3*a*. In the half-plugged state where the upper edge of the concave part 3*c* is located above the upper edge of the mouth 2, there is an air-flow pathway through the convert part 3*c* between the rubber plug 3 and the mouth 2. In the completely plugged state where the flange 3*b* is connected to the upper edge surface of the mouth 2; the upper edge of the concave part 3*c* is located nearer to the inside of the container (i.e. underside) than the upper edge of the mouth 2, so as to seal the mouth 2 airtight.

Figure 2:
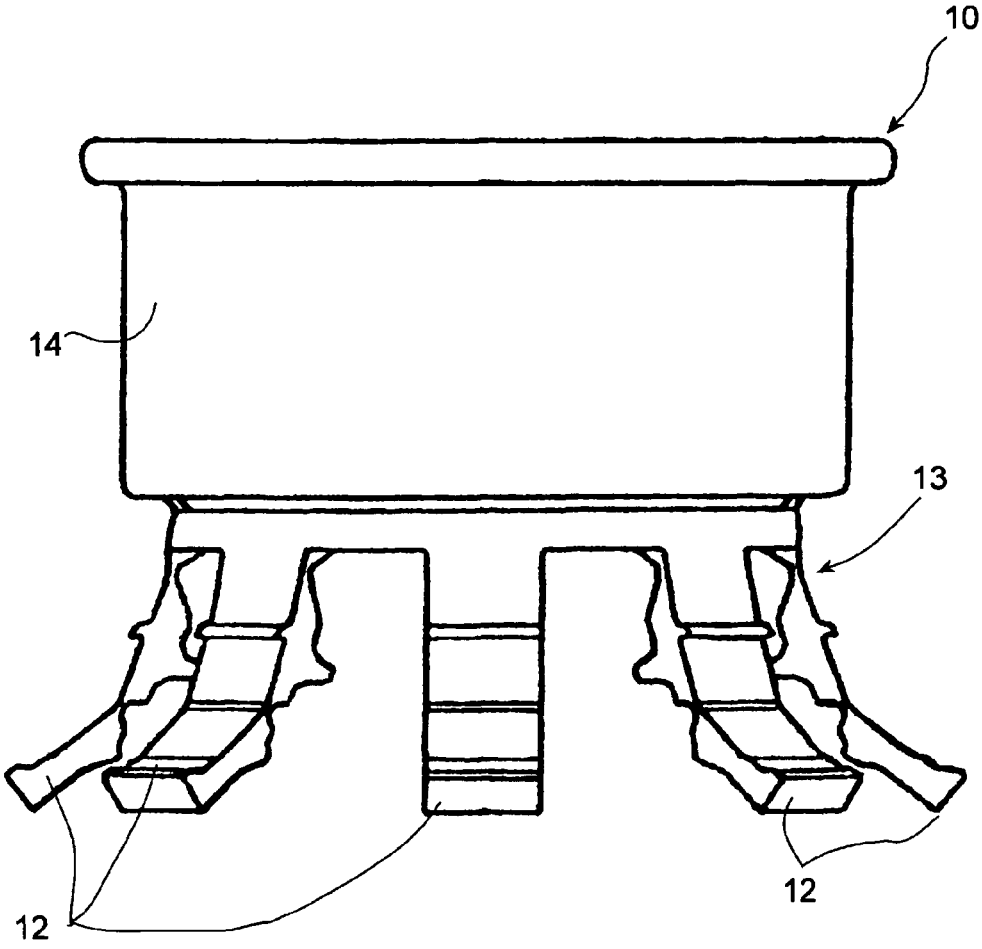
FIG. 2 is a full elevation view of the cap.

The cap 10 mainly comprises a locking member 13, which has a disco-tic top plate 11 contacting to the rubber plug 3 and a plurality of locking pieces 12 crown-like located around the disco-tic top plate 11; and a holder member 14, which is mounted surrounding the outer periphery of the locking pieces 12. The locking member 13 and the holder member 14 are, as shown in FIG. 1 and FIG. 2, manufactured by means of integral molding. Whilst putting on the cap, after the vial 1 gets filled, the rubber plug 3 and the holder member 14 are separated from each other by pushing the holder member 14 to cut a rib-shaped connecting part 15 which connects them. The connecting part 15 could be located on a few points (e.g. four points) on a circumference of the holder member 14. The cap 10 is preferably molded from incineratable and discardable plastic.

In the embodiment shown in the figures, eight locking pieces 12 locate equally spaced circumferentially to surround the mouth 2; and a plurality of slits are formed respectively between two locking pieces 12 next to one another. Each locking piece 12 has a vertically elongated shape, extending downward from the rim of the plate 11, and its lower part is radially elastic deformable. Before the deformation, as shown in FIG. 1, its lower side is formed to be larger, circumferentially outward, than its upper side. Additionally, each locking piece 12 is formed in a shape where an upper side part 12U and a lower side part 12D is connected through a discrete thin-walled bendable part 12*a* located in the middle of the piece in the longitudinal direction; it is possible to expand the lower side part 12D without expanding the upper side part 12U. The bendable part 12*a* is locally thinner than the upper and lower side parts 12U, 12D, respectively. In the embodiment shown in the figures, each of the upper side part 12U and the lower side part 12D has substantially rigidity; and making the thin-walled bendable part between the upper side and the lower side of the locking piece 12 enables its lower side part 12D to be movable radially relative to the upper side part 12U by bending at the locally thinned location between the parts 12D, 12U that functions as a hinge so that the locking piece 12 is to be deformable.

A projected part 12*b* capable of engaging with the flange 4*b* from below as a result of going into the gap between the flange 3*b* of the mouth 2 and the flange 2*a* of the mouth 2 from outside in a direction of the radius, is provided in the inner peripheral side of the upper side part 12U of the locking piece 12. On the other hand, in the inner peripheral side of the lower side part 12D of the locking piece 12, there is an engaging projected part 12*c* capable of engaging with the flange 2*a* from below. A stretching part 12*d* is provided at the lower edge of the locking piece 12 and projects toward outside in the direction of the radius. Additionally, A locking projected part 12*e*, which is engaged with an inward locking projected part 14*a* of the holder member 14 hereinafter described, is provided in the outer periphery of the upper side part 12U of the locking piece 12.

The holder member 14 comprises a cylinder, which has a bore diameter somewhat larger than the external diameter of the top plate 11; and it is movable upwards and downwards relative to the locking member 13, so that it is attached outside to a plurality of locking pieces. A flange 14*b* protruding outwardly in the direction of the radius is provided at the upper edge of the holder member 14. The inward locking projected part 14*a* protruding inwardly in the direction of the radius is provided at the lower edge of the holder member 14. The bore diameter of this locking projected part 14*a* is designed to be almost the same size as the external diameter of the top plate 11. The length of the axis of the holder member 14 is almost the same as the length of the axis of the locking member 13. Aforementioned connecting part 15 is connected to the inner edge of the locking projected part 14*a*.

The locking projected part 14*a* of said holder member 14 and the locking projected part 12*e* of the locking member 13 are built to be a hooked shape, so that they can slip when the holder member 14 is pushed and they can lock each other when the holder member 14 is pulled out. Therefore, when the holder member 14 is pulled out, the locking projected parts 12*e* and 14*a* lock each other. This prevents the lower edge of the holder member 14 from moving higher relative to the upper side part 12U; and the locking member 13 is pulled out together with the holder member 14, which holds the upper side part 12U in position and shrunken.

Figure 3:
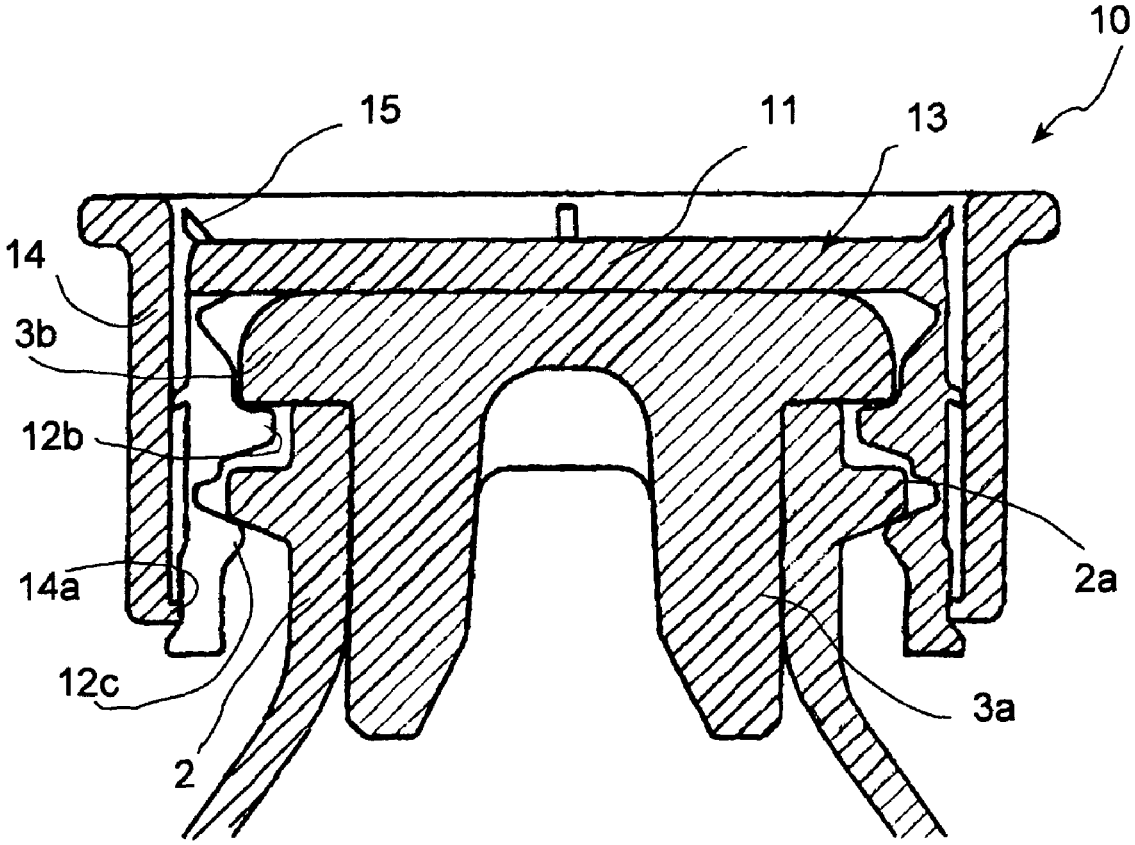
FIG. 3 is a longitudinal sectional view of the cap having been attached to the mouth.

To attach the cap 10 of the aforementioned embodiment, put the locking member 13 of the cap 10, which is integrally molded with the holder member 14, on the mouth of the vial 2 and push down the holder member 14, as shown in FIG. 1; so that the connecting part 15 is severed, the holder member 14 moves to the lower position of the locking part 13, and the holder member 14 is in a state where the holder member 14 is attached around the outer periphery of the plurality of locking pieces 12, as shown in FIG. 3. In this state, the plurality of locking pieces 12 are squeezed and shrunk; the locking projected part 12*b* of the upper side part 12U is locked to the flange 3*b* of the rubber plug 3 from below, as well as the locking projected part 12*c* of the lower side part 12D is locked to the flange 2*a* of the vial mouth 2 from below; so that the rubber plug 3 is locked by the locking member 13 without fail.

Figure 4:
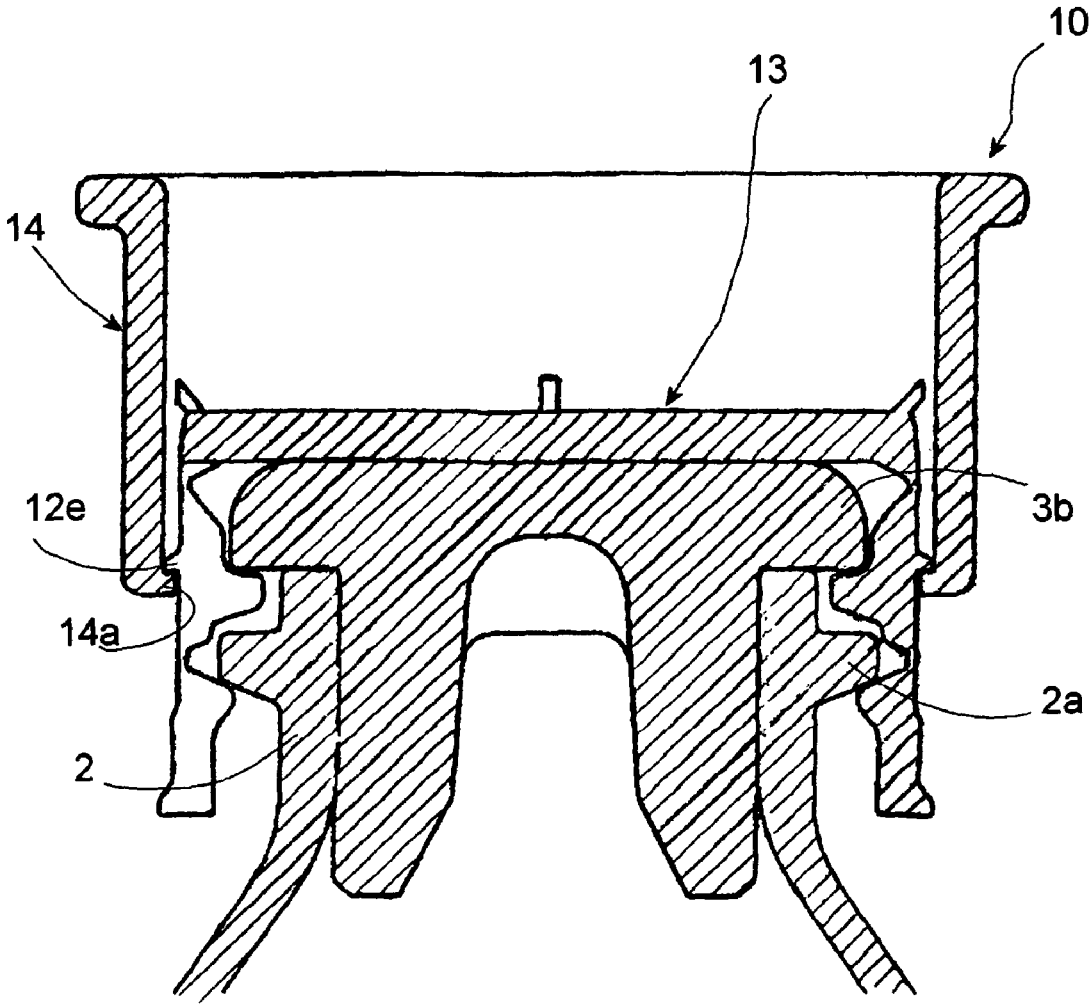
FIG. 4 is a longitudinal sectional view of a process diagram illustrating a disassembling process for the cap.
Figure 5:
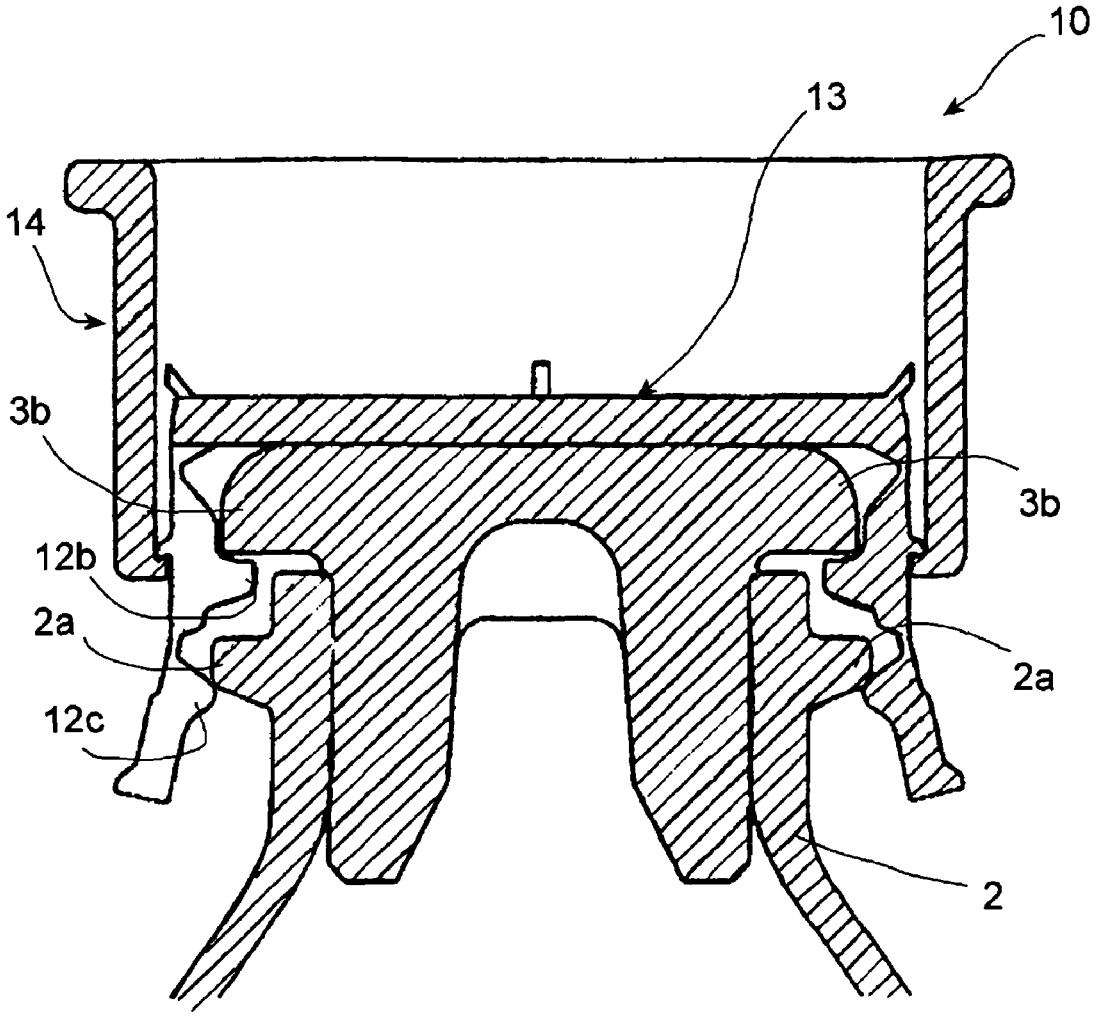
FIG. 5 is a longitudinal sectional view of a process diagram illustrating another exemplary disassembling process for the cap.
Figure 6:
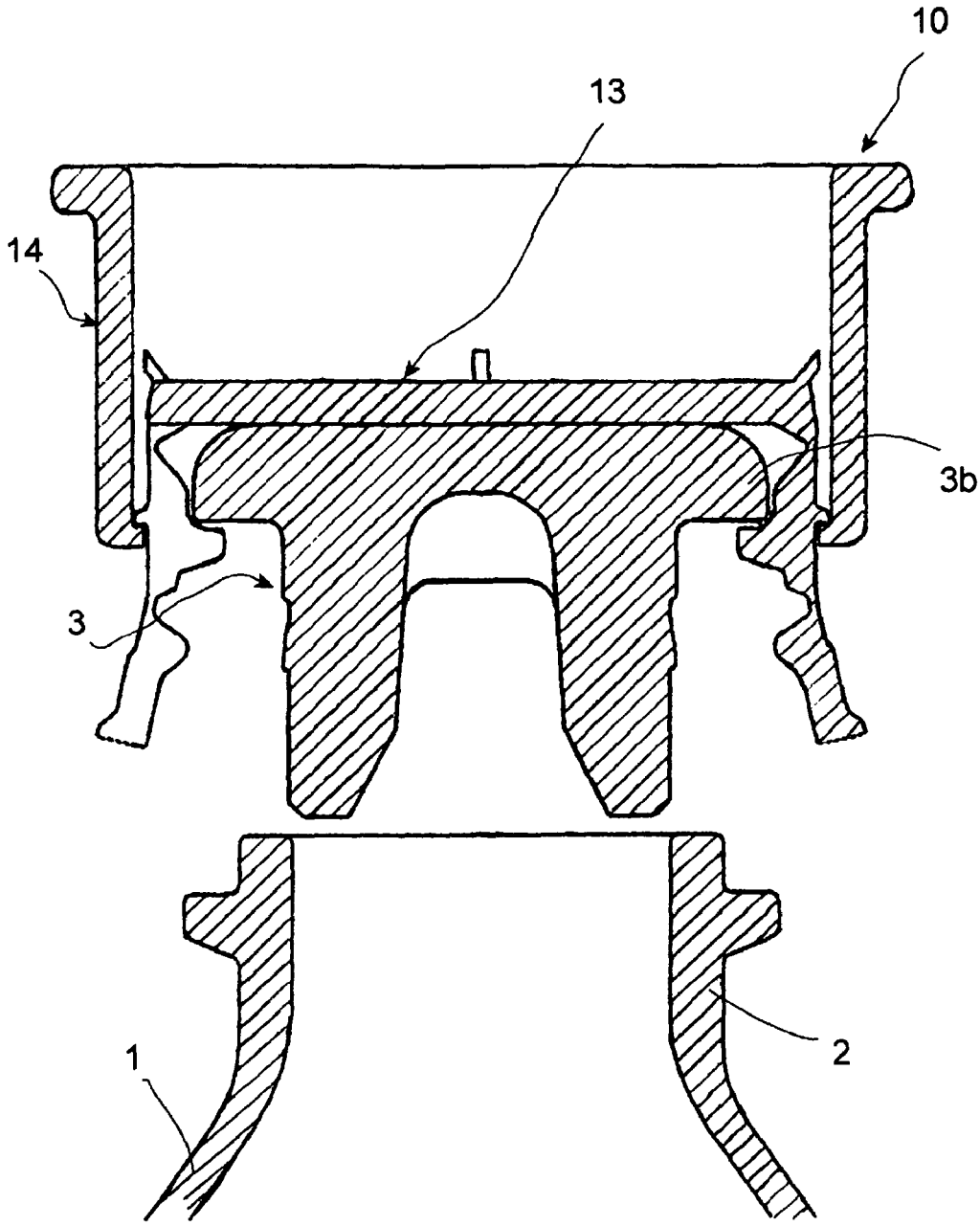
FIG. 6 is a longitudinal view of a process diagram further illustrating another exemplary disassembling process for the cap.

In order to open the plug, pull the holder member 14 upward; as shown in the FIG. 4, the holder member 14 moves upward and disengages from the lower side part 12D, and the locking projected part 14*a* is locked to the locking projected part 12*e* of the outer peripheral of the upper side part 12U of the locking piece 12 from below. Further pull the holder member 14, in the state the upper side part 12U stays shrunk, i.e. the holder 14 keeps holding the rubber 3, the rubber plug 3 is pulled out upward with the holder member 14, as shown in the FIG. 5 and 6. In this manner, only pulling out the holder member 14 whose gripping area is large enables the user to pull out the rubber plug 3 easily from the mouth 2; so that there is no need to unclench the rubber plug 3 after detaching the cap 10 of this embodiment. Therefore, when opening the plug in need, it is possible to do so with swiftness and ease while locking the rubber plug 3 without fail.

The present invention is not limited to the arrangement described in the embodiment, but may be arbitrarily modified. For example, a screw may be attached to the outer peripheral side of the locking piece and the inner peripheral side of the holder member. In this case, the screw may form the said locking projected part.

According to the present invention, it is possible to open both the cap and the plug with swiftness and ease from the mouth by pulling out the holder member when opening the cap, while the plug is locked firmly to the mouth by the locking member when attaching the cap to the container.

The invention claimed is:

1. A container cap which is put on a mouth of a container to top a plug member fitted into the mouth, the cap comprises:

a locking member which has a top plate with a rim and a plurality of locking pieces located around the rim; and a holder member which is mounted surrounding an outer periphery of the locking pieces, wherein each locking piece is extended downward from the rim and has a longitudinal extent;

wherein each locking piece comprises an upper side part with an outer periphery and a lower side part with an outer periphery connected to the upper side part by a thin-walled bendable part located midway through the piece in a longitudinal direction thereof that functions as a hinge;

wherein the upper side part is locked to said plug member to directly engage the plug member from below in a state where the holder member is mounted on the outer periphery of the upper side part thereof;

wherein said lower side part is locked to a part of said mouth from below in a state where the holder member is mounted on the outer periphery of the lower side part thereof;

wherein said holder member is movable upwards and downwards relative to the locking member;

wherein at least one of said holder member and said locking member has a locking projected part which blocks upward movement of the lower edge of the holder member relative to the upper side part of the locking piece as the holder member is moved upwardly from the state wherein the holder member is mounted on the outer periphery of the lower side part, wherein each of the holder member and the locking piece has a locking projected part, the locking projected part of the holder member being formed on an inner periphery of a lower edge of the holder, the locking projected part of the locking piece being formed on the outer periphery of the upper side part; and a connecting part which connects an upper edge of the locking member and a lower edge of the holder and is severable by pushing down the holder member relative to the locking member, whereby with the container cap on the mouth of a container, the holder member can be pushed downwardly relative to the locking member to sever the lower edge of the holder member and allow the holder member to surround the locking pieces so that the upper and lower side parts are thereby maintained respectively against a part of the mouth and the plug from below each of the part of the mouth and the plug to secure the container cap to the container, whereupon upward movement of the holder member causes the locking projecting parts on the holder member and locking pieces to interact so that as the holder member is moved upwardly the locking pieces are repositioned initially causing the lower side parts to bend outwardly at the hinges to separate from below the part of the mouth and thereafter causing the upper side parts to bear against the plug and cause the upper side parts to draw the plug from the mouth as the holder member is moved further upwardly.

2. A container cap as set forth in claim 1, wherein an external diameter of the lower side part of one of the locking pieces is larger than an external diameter of the upper side part of the one locking piece in a state where the holder member is mounted on an outer periphery of the one locking piece.

3. The container cap according to claim 1 wherein the thin-walled bendable part is locally thinner than the upper and lower side parts so that the lower side part bends relative to the upper side part at the bendable part that functions as a hinge.

4. The container cap according to claim 1 in combination with a container having a mouth and a plug member fitted into the mouth.

5. The container cap according to claim 4 wherein the container mouth has an upper edge surface and the plug member comprises a flange that contacts the upper edge surface and an airtight portion that depends from the flange and extends into the container mouth with the plug member fitted into the mouth.

6. The container cap according to claim 5 wherein the airtight portion extends a significant distance into the mouth to tightly fit into the mouth.

7. A container cap which is put on a mouth of a container to top a plug member fitted into the mouth, the cap comprises:

a locking member which has a top plate with a rim and a plurality of locking pieces located around the rim; and a holder member which is mounted surrounding an outer periphery of the locking pieces, wherein each locking piece is extended downward from the rim and has a longitudinal extent;

wherein each locking piece comprises an upper side part with an outer periphery and a lower side part with an outer periphery connected to the upper side part by a thin-walled bendable part located midway through the piece in a longitudinal direction thereof that functions as a hinge;

wherein the upper side part is locked to said plug member to engage the plug member from below in a state where the holder member is mounted on the outer periphery of the upper side part thereof;

wherein said lower side part is locked to a part of said mouth from below in a state where the holder member is mounted on the outer periphery of the lower side part thereof;

wherein said holder member is movable upwards and downwards relative to the locking member; and wherein at least one of said holder member and said locking member has a locking projected part which blocks upward movement of the lower edge of the holder member relative to the upper side part of the locking piece as the holder member is moved upwardly from the state wherein the holder member is mounted on the outer periphery of the lower side part.

8. A container cap as set forth in claim 7, wherein each of the holder member and the locking piece has a locking projected part, the locking projected part of the holder member being formed on an inner periphery of a lower edge of the holder, the locking projected part of the locking piece being formed on the outer periphery of the upper side part, and the cap further comprising a connecting part which connects an upper edge of the locking member and a lower edge of the holder and is severable by pushing down the holder member relative to the locking member, and the holder member, the locking member, and the connecting part being integrally molded.

9. A container cap as set forth in claim 7, wherein each of the holder member and the locking piece has the locking projected part, the locking projected part of the holder member being formed on a lower edge of the holder member, the locking projected part of the locking piece being formed on the outer periphery of the upper side part.

10. A container cap as set forth in claim 7, wherein the upper side part directly engages the plug member from below.

11. The container cap according to claim 7 wherein the holder member and locking member are configured so that as the holder member is moved upwardly from the state wherein the holder member is mounted on the outer periphery of the lower side part the holder member causes the locking member to draw the plug member from the mouth.

12. The container cap according to claim 7 wherein with the locking projected parts are engaged, the locking projected part on the holder acts against the locking projected part on the locking member to thereby cause the locking member to follow upward movement of the holder member.

13. The container cap according to claim 7 in combination with a container having a mouth and a plug member fitted into the mouth.

14. The container cap according to claim 13 wherein the holder member and locking member are configured so that as the holder member is moved upwardly from the state wherein the holder member is mounted on the outer periphery of the lower side part the holder member causes the locking member to draw the plug member from the mouth.

15. The container cap according to claim 7 wherein the holder member and locking member are configured so that as the holder member is moved upwardly relative to the locking member, the locking projected parts engage so that the locking member follows further upward movement of the holder member.

16. The container cap according to claim 15 wherein the locking projected part on the holder member is at a lower edge of the holder member and the locking projected parts engage with the lower edge of the holder member above the lower side part so that the lower side part can separate from the mouth.

17. The container cap according to claim 16 wherein the holder part surrounds the upper side part so that the upper side part is locked to the plug member with the locking projected parts engaged.

* * * * *